US008294541B2

(12) United States Patent
Soldo et al.

(10) Patent No.: US 8,294,541 B2
(45) Date of Patent: Oct. 23, 2012

(54) HERMETIC SWITCH DEVICE ACTIVATED MAGNETICALLY

(75) Inventors: Giovanni Soldo, Brescia (IT); Fabrizio Guidetti, Brescia (IT)

(73) Assignee: Soldo S.r.L. Socio Unico, Desenzano del Garda, Brescia (IT)

( * ) Notice: Subject to any disclaimer, the term of this patent is extended or adjusted under 35 U.S.C. 154(b) by 84 days.

(21) Appl. No.: 12/859,945

(22) Filed: Aug. 20, 2010

(65) Prior Publication Data

US 2011/0205004 A1 Aug. 25, 2011

(30) Foreign Application Priority Data

Nov. 13, 2009 (IT) ..... BS2009A0207

(51) Int. Cl.
*H01H 9/00* (2006.01)

(52) U.S. Cl. ..... 335/205; 335/207

(58) Field of Classification Search ..... 335/205
See application file for complete search history.

(56) References Cited

U.S. PATENT DOCUMENTS

| | | | | |
|---|---|---|---|---|
| 3,264,424 | A * | 8/1966 | Baermann | 335/207 |
| 4,915,431 | A * | 4/1990 | Bailey | 292/251.5 |
| 6,552,314 | B2 * | 4/2003 | Fukushima et al. | 219/723 |
| 2001/0032841 | A1 * | 10/2001 | Fukushima et al. | 219/723 |

* cited by examiner

*Primary Examiner* — Elvin G Enad
*Assistant Examiner* — Lisa Homza
(74) *Attorney, Agent, or Firm* — Shoemaker and Mattare

(57) ABSTRACT

A switch device includes a container of the hermetic type, at least one switch contained inside the hermetic container, and actuation devices at least partially contained inside the container and suitable to actively select the switch. The actuation devices have at least one internal ferromagnetic element, moving inside the container so as to influence an actuation button of the switch, and a transmission body having a first extremity which interfaces in contact with said internal ferromagnetic element and a second extremity which interfaces in contact with said actuation button. The transmission body is a rigid body which receives and transmits the movement of the internal ferromagnetic element from a rest position in which it does not cause the actuation button to be actuated and a functioning position in which it presses and acts on the actuation button by contact.

15 Claims, 3 Drawing Sheets

HERMETIC SWITCH DEVICE ACTIVATED MAGNETICALLY

FIELD OF THE INVENTION

The present invention relates to a switch device and in particular to a hermetic switch device activated magnetically.

BACKGROUND OF THE INVENTION

Hermetic switches of the prior art are used for example in user devices where the environment which the switch is used in contains gases carrying the risk of explosion or which, in any case may prejudice the functioning and/or useful life of the switch should they get into it.

For this reason in the prior art switches are put into hermetic containers provided with sealing elements. Such switches, being hermetically closed, are usually actuated from outside without a direct mechanical contact but for example by means of a magnetic type actuation.

It is, for example, known of to use at least one magnetic actuator which exerts a magnetic force on spring mechanisms operatively connected to the switch and positioned inside the container of the latter.

The switches of the prior art present a number of drawbacks and limitations related mainly to the reliability and duration of the actuation mechanisms.

In fact, such switches are subject to an extremely high number of cycles during the life of the switch, as a result of which they are subject to fatigue stress often causing them to break prematurely.

In particular, such fatigue stress usually causes breakage of the spring mechanisms acting on the inner switch.

SUMMARY OF THE INVENTION

The purpose of the present invention is to make a switch device which overcomes the drawbacks mentioned with reference to the prior art.

Such drawbacks and limitations are resolved by a switch device as described below.

Other embodiments of the switch device according to the invention are described as well.

BRIEF DESCRIPTION OF THE DRAWINGS

Further characteristics and advantages of the present invention will be more comprehensible from the description given below, by way of a non limiting example, of its preferred embodiments wherein.

DETAILED DESCRIPTION OF THE INVENTION

Figure 1:
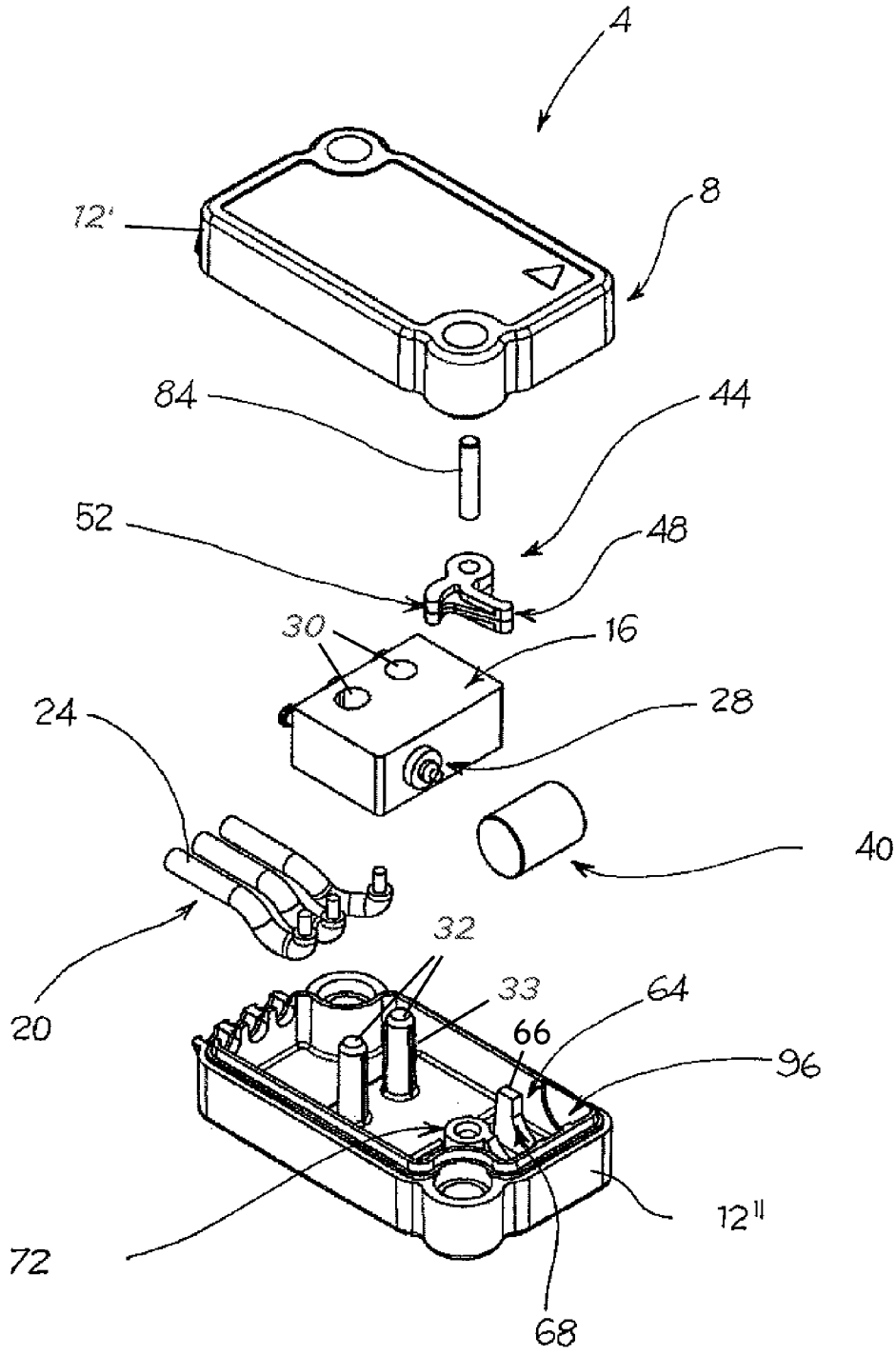
FIG. 1 shows a perspective view, in separate parts, of a switch device according to one embodiment of the present invention.
Figure 2:
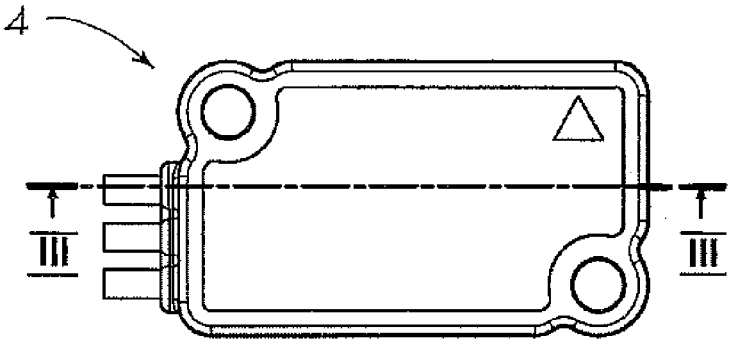
FIG. 2 shows an overhead view of the switch in FIG. 1, in one assembly configuration.
Figure 3:
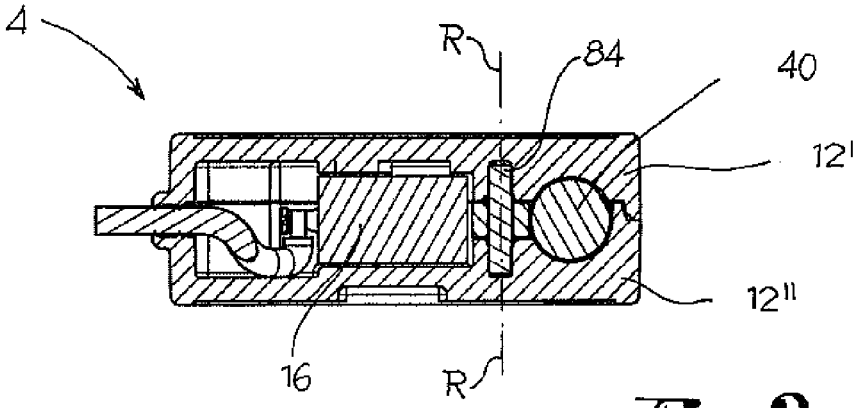
FIG. 3 shows a cross-section view of the switch in FIG. 2, along the cross-section plane III-III in FIG. 2.

The elements or parts of elements common to the embodiments described will be indicated below using the same reference numerals.

With reference to the aforesaid figure, reference numeral 4 globally denotes a switch device suitable for being electrically connected to user devices of any type.

The switch device 4 comprises a hermetic container provided with sealing elements able to guarantee the hermeticity of the device from the external environment which it is located in.

Such hermeticity of the container 8 may, for example, be achieved by the use of sealing elements appropriately positioned between the respective casings 12', 12" of the container 8.

It is also possible to use welding, for example by ultrasound, to seal the casings 12', 12"; in addition the casings may be sealed by gluing 12', 12".

The switch device 4 comprises at least one switch 16 contained inside said hermetic container 8, the switch 16 being electrically connected to at least one connection terminal 20 for the electric connection of the switch device 4 to a user device outside the container 8.

Preferably, the connection terminals 20 are covered so as to ensure the hermeticity of the container 8; for example the connection terminals 20 coming out of the container 8 can be suitably covered in rubber sheaths 24.

The switch 16 may be of various types and preferably comprises an actuation button 28 which, when pressed, causes its actuation and/or deactivation.

Preferably, the switch 16 comprises internal elastic means, such as for example a spring, which exerts an elastic effect such as to return the actuation button 28 to the extracted configuration when it is not pressed.

According to one embodiment, the switch 16 comprises a pair of positioning and attachment holes 30, able to permit the positioning and attachment of the switch 16 inside the container 8.

Said positioning and attachment holes 30 are aligned in a positioning direction Y-Y perpendicular to the actuation stroke of the actuation button 28.

The positioning and attachment holes 30 may be cylindrical and, preferably, at least one of them is a slotted hole 31. Preferably, said slot extends parallel to the positioning direction Y-Y, passing through the centres of said holes 30.

According to one embodiment, the container 16 comprises corresponding positioning and attachment pegs suitable for being housed in said positioning and attachment holes 30. Preferably the positioning and attachment pegs 32 comprise at least one rib 33 able to form an interference coupling with the relative positioning and attachment hole 30. Preferably, in the coupling position, the ribs 33 flex to adapt to the dimensions of the specific switch 16 compensating the dimensional coupling variance resulting from tolerance in the production process. In particular, preferably a first peg 32', able to couple with a relative cylindrical, non-slotted hole 30, comprises three ribs positioned angularly at set intervals so as to ensure the symmetrical centring of the peg in the hole. Preferably a second peg 32" comprises a pair of ribs 33", positioned diametrically opposite each other and perpendicular to said positioning direction Y-Y: this way the slotted hole 31 permits adjustment along the positioning direction Y-Y only and not along the actuation stroke of the actuation button 28.

The device 4 comprises, in addition, actuation devices at least partially contained inside the container 8, said actuation devices being able to selectively actuate the switch 16.

Advantageously the actuation devices comprise at least one internal ferromagnetic element 40, moving inside the container 8 so as to strike against the actuation button 28.

In addition, the actuation devices comprise a transmission body 44 having a first extremity 48 which interfaces in contact with said internal ferromagnetic element 40 and a second extremity 52 which interfaces in contact with said actuation button 28.

The transmission body 44 is advantageously a rigid body which receives and transmits the movement of the internal ferromagnetic element 40 from a rest position in which it does cause the actuation button 28 to be actuated and a functioning position in which it pushes and acts on said actuation button 28 by contact.

The term rigid body is taken to mean that the transmission body 44 is not a spring which flexes or bends under the effect of a magnetic force so as to allow or prevent actuation of the actuation button 28, but rather is a sort of mechanical transmission which rigidly transmits the movement received from the internal ferromagnetic element 40 and/or from the actuation button 28. In other words again, the transmission body 44 does not flex in any way either under the thrust of the actuation button 28 or under the thrust of the internal ferromagnetic element 40 but, rather, merely shifts to transmit the movement from the former.

The actuation devices further comprise at least one actuation magnet 56, outside the container 8 able to exert a force of attraction and/or repulsion on the internal ferromagnetic element 40, so as to move the internal ferromagnetic element 40 and act on the actuation button 28.

For example, said actuation magnet 56 is supported by a mobile translating and/or rotating support so as to be distanced from and/or brought closer to the container 8 and selectively influence the internal ferromagnetic element 40.

Figure 6:
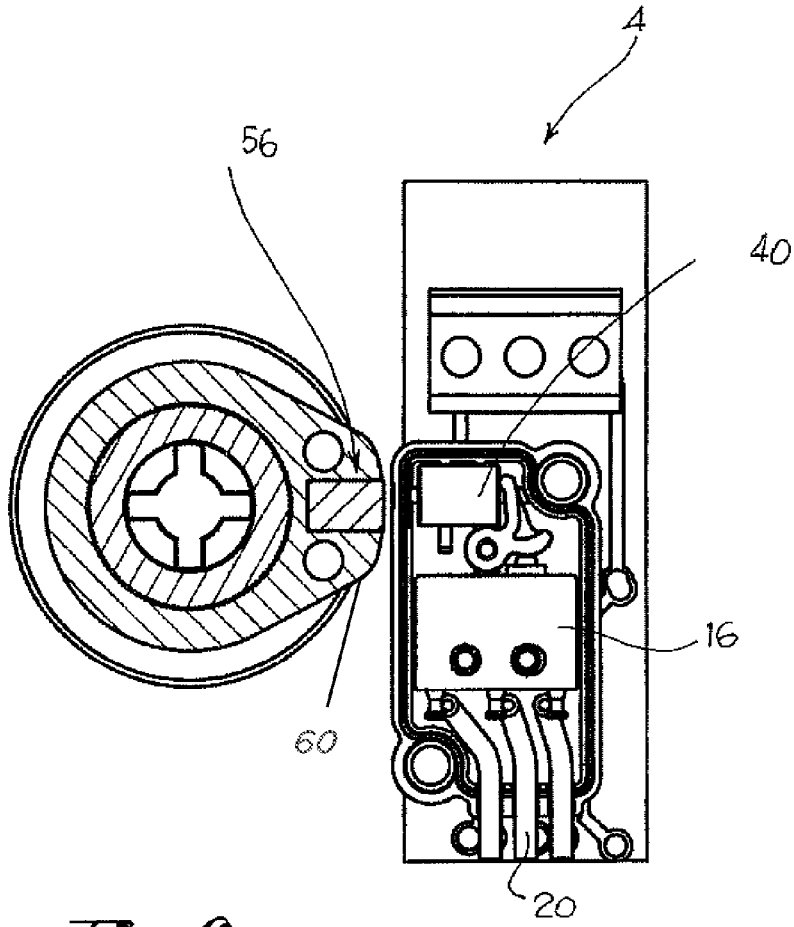
FIG. 6 shows a cross-section view of a switch according to the present invention, provided with an external actuation device.

By way of example, the actuation magnet 56 may be housed in a cam 60 rotating around a rotation axis so as to be cyclically distanced from or come closer to the container, at the point of the internal ferromagnetic element 40, and thereby actuate and/or deactivate the switch 16 (FIG. 6).

It is also possible to use different types of vectors to distance the actuation magnet 56 from and/or bring it closer to the container 8, such as for example moving arms, carriages, slides and the like.

Preferably, the internal ferromagnetic element 40 is housed in a seat 64 of the container 8 at least partially counter-shaped to the element itself so as to guide its movement during actuation of the actuation button 28.

According to one embodiment, the internal ferromagnetic element 40 is a cylindrical body and the seat 64 comprises at least one bracket 66 fitted with a groove 68 having the same diameter as the diameter of said ferromagnetic element 40, so as to guide the translation movement of the cylindrical body.

Preferably, the transmission body 44 is made in non-magnetic material so as not to be influenced by the magnetic field of the actuation devices.

For example, the transmission body 44 is made from a polymer material ensuring lightweight, resistance and a low friction coefficient during movement.

Preferably, the transmission body 44 is guided in its actuating movement by at least one inner guide 72 of the container 8. For example, said inner guide 72 comprises at least one support plane counter-shaped to the transmission body 44.

According to a preferred embodiment, the transmission body 44 is a lever and pivots on a pin 84 so as to rotate under the thrust of the internal magnetic element.

Preferably, the pin 84 is positioned along a rotation axis R-R perpendicular to the actuation axis X-X.

According to one embodiment, the transmission body comprises a first and a second protuberance 88,92, the first protuberance 88 terminating in a first extremity 48 in contact with the internal ferromagnetic element 40 and the second protuberance 92 terminating in a second extremity 52 in contact with the actuation button 28.

Preferably, the transmission body 44 is inserted without play between internal ferromagnetic element 40 and the actuation button 28. In particular, in the rest position, when the internal ferromagnetic element 40 is not subject to the effect of the external magnetic field, the internal spring 46 (FIG. 5) of the switch 16 keeps the actuation button 28 in the extracted configuration so as to press the internal ferromagnetic element 40 against a stop wall 96 of its seat 64. This way any play in the kinematic chain between the actuation devices and the switch is annulled and unwanted vibrations and shifting of the internal ferromagnetic element 40 are prevented.

The functioning of the switch according to the invention will now be described.

In particular, in the rest condition, the internal spring of the switch 16 exerts an elastic force which prevails over the internal magnetic element 40 and the actuation devices. In other words, the switch 16 remains in a condition of non-actuation and the actuation button 28 finds itself in the extracted position.

Figure 4:
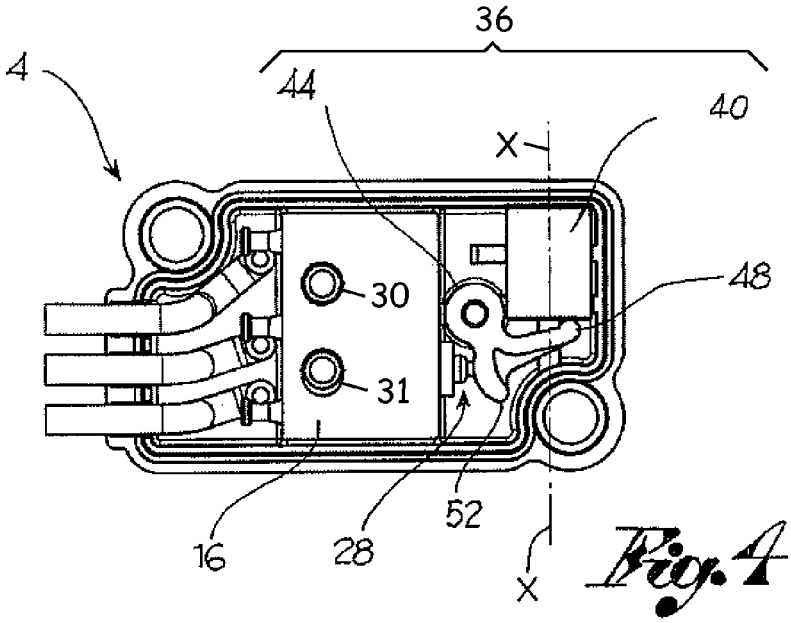
FIG. 4 shows a partial cross-section view of the switch in FIG. 1, in a rest configuration.

The transmission body 44 preferably finds itself in contact with the actuation button 28 at the second extremity 52 as well as in contact with the internal magnetic element 40 at the first extremity 48 (FIG. 4).

To activate the switch 16 a magnetic field needs to be created around the internal magnetic element, for example by placing a magnet outside the container near the seat 64.

Figure 5:
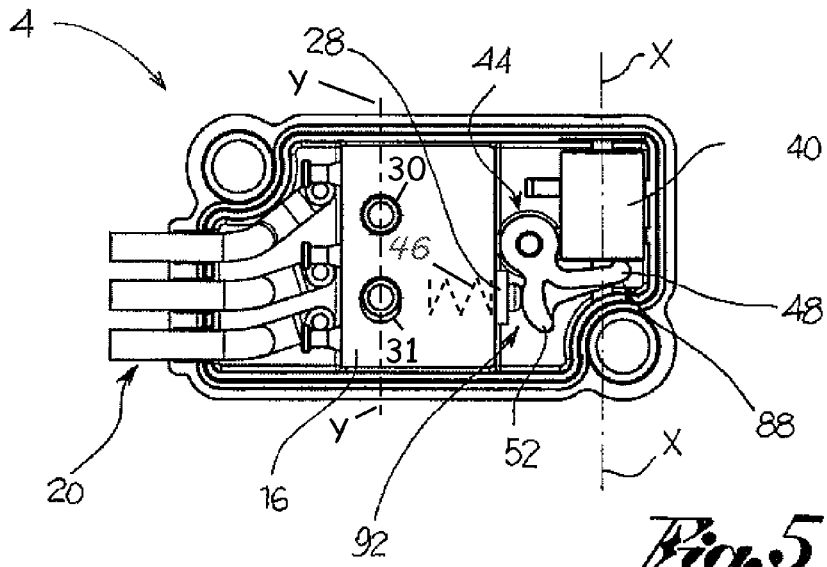
FIG. 5 shows a partial cross-section view of the switch in FIG. 1, in a functioning or actuation configuration.

If, for example, the external actuation magnet 56 is the same polarity as the polarity of the internal ferromagnetic element 40, this shifts in its seat 64 and drags the transmission body 44 with it, overcoming the elastic force of the spring of the switch 16 and actuating the latter by pressing the actuation button 28 with the second extremity 52 of the transmission body 44 (FIG. 5).

There are various ways of creating the external magnetic field around the internal ferromagnetic element 40: for example a cam 60 comprising a magnet on its extremity may be used: this way during rotation of the cam 60, said magnet is cyclically brought close up to the internal magnetic element 40 so as to shift it and actuate the switch 16.

As already described it is possible to create the external magnetic field in various other ways.

When the external magnetic field ceases to significantly influence the internal ferromagnetic element 40, for example because the external actuation magnet 56 draws farther away during rotation of the cam 60, the internal spring of the switch 16 prevails and raises the actuation button 28 shifting both the transmission body 44 and the internal ferromagnetic element 40 against the respective stop wall 96.

This operation can be repeated cyclically for thousands of cycles.

As may be seen from the description above, the switch device according to the invention makes it possible to overcome the drawbacks spoken of in relation to the prior art.

In particular, the device is able to function continuatively in corrosive and/or hazardous environments without breakage or damage.

The device withstands extremely high resistance to stress given that it does not contain elastic devices of the leaf spring type, used for example in the prior art.

In fact, the transmission body is a rigid element which transmits the movement received from the internal magnetic element. Such element does not therefore undergo elastic deformation and is preferably subject to compression stress.

Advantageously, the actuation lever is in non-magnetic material so as not to be influenced by the magnetic field of the switch: this way it is possible to calibrate the functioning of the switch, that is, the intensity of the magnetic field to apply externally to the container to actuate the switch, in relation solely to the elastic constant of the internal spring of the switch.

In other words, the magnetic force needs only overcome the elastic force exerted by the internal spring of the switch without the actuation mechanisms themselves being in turn influenced by the magnetic field.

This way it is also simpler to scale the intensity of the magnetic actuation field of the switch, also bearing in mind any vibrations present in the environment which the switch is used in.

In fact, the device has no leaf springs which would be subject to vibrations more difficult to control and to stress breakage.

Advantageously, the ribs positioned on the positioning and attachment pegs make it possible to control the position of the switch with extreme precision and, particularly, the actuation button, in relation to the actuation devices along the actuation axis. This way it is possible to ensure functioning of the switch device even using actuation devices with extremely reduced actuation strokes.

A person skilled in the art may make numerous modifications and variations to the switch devices described above so as to satisfy contingent and specific requirements while remaining within the scope of protection of the invention as defined by following claims.

We claim:

1. Switch device comprising a container of the hermetic type, provided with sealing elements able to guarantee hermeticity of the device from outside environment in which there is at least one switch contained inside said hermetic container, the at least one switch being electrically connected to at least one connection terminal for electric connection of the switch device to a user device outside the container, actuation devices at least partially contained inside the container, said actuation devices being able to actively select the switch, wherein the actuation devices comprise at least one internal ferromagnetic element, moving inside the container so as to influence an actuation button of the switch, and wherein the actuation devices comprise a transmission body having a first extremity which interfaces in contact with said at least one internal ferromagnetic element and a second extremity which interfaces with said actuation button, the transmission body being a rigid body which receives and transmits movement of the internal ferromagnetic element from a rest position in which it does not cause the actuation button to be actuated and a functioning position in which it pushes and acts on the actuation button by contact.

2. Switch device according to claim 1, wherein the actuation devices comprise at least one actuation magnet, outside the container and able to exert a magnetic force on the internal ferromagnetic element, so as to move the internal ferromagnetic element and act on the actuation of the switch.

3. Switch device according to claim 2, wherein said actuation magnet is supported by a mobile support which permits the actuation magnet to be distanced from or brought close up to the container and to selectively influence the internal ferromagnetic element.

4. Switch device according to claim 1, wherein the internal ferromagnetic element is housed in a seat of the container at least partially counter shaped to the internal ferromagnetic element, so as to guide its movement during operation of the switch.

5. Switch device according to claim 4, wherein the internal ferromagnetic element is a cylindrical body and the seat comprises at least one bracket fitted with a groove having the same diameter as the diameter of said internal ferromagnetic element, so as to guide translational movement of the cylindrical body.

6. Switch device according to claim 1, wherein the transmission body is made of a non-magnetic material so as not to be influenced by a magnetic field of the actuation devices.

7. Switch device according to claim 1, wherein the transmission body is made of a polymeric material.

8. Switch device according to claim 1, wherein the transmission body is guided in its actuating movement by at least one inner guide of the container.

9. Switch device according to claim 8, wherein said at least one inner guide comprises at least one support plane counter-shaped to the transmission body.

10. Switch device according to claim 1, wherein the transmission body comprises a lever pivoted on a pin so as to rotate under thrust of the internal ferromagnetic element.

11. Switch device according to claim 10, wherein the lever comprises a first and a second protuberance, the first protuberance terminating in a first extremity in contact with the internal ferromagnetic element and the second protuberance terminating in a second extremity in contact with the actuation button.

12. Switch device according to claim 10, wherein the lever is inserted without play between the internal ferromagnetic element and the actuation button.

13. Switch device according to claim 1, wherein the switch contains a spring which exerts an elastic force upon said button such as to return the transmission body to an extracted rest position when the internal ferromagnetic element is not subject to the effect of an external magnetic field.

14. Switch device according to claim 1, wherein the switch comprises a pair of positioning and attachment holes, able to permit the positioning and attachment of the switch inside the container, and wherein the container comprises corresponding positioning and attachment pegs suitable for being housed in said positioning and attachment holes, the positioning and attachment pegs comprising at least one rib able to form an interference coupling with the relative positioning and attachment hole.

15. Switch device according to claim 14, wherein said positioning and attachment holes are aligned in a positioning direction perpendicular to an operating stroke of the actuation button.

* * * * *